US009970449B2

(12) United States Patent
Ueda et al.

(10) Patent No.: US 9,970,449 B2
(45) Date of Patent: May 15, 2018

(54) EXPANDER-INTEGRATED COMPRESSOR, REFRIGERATOR AND OPERATING METHOD FOR REFRIGERATOR

(71) Applicant: MAYEKAWA MFG. CO., LTD., Tokyo (JP)

(72) Inventors: Shota Ueda, Tokyo (JP); Akito Machida, Tokyo (JP); Mizuo Kudo, Tokyo (JP)

(73) Assignee: MAYEKAWA MFG. CO., LTD., Tokyo (JP)

( * ) Notice: Subject to any disclaimer, the term of this patent is extended or adjusted under 35 U.S.C. 154(b) by 0 days. days.

(21) Appl. No.: 15/034,179

(22) PCT Filed: Oct. 9, 2014

(86) PCT No.: PCT/JP2014/077109
§ 371 (c)(1),
(2) Date: May 4, 2016

(87) PCT Pub. No.: WO2015/068522
PCT Pub. Date: May 14, 2015

(65) Prior Publication Data

US 2016/0265545 A1 Sep. 15, 2016

(30) Foreign Application Priority Data

Nov. 11, 2013 (JP) ..... 2013-233149

(51) Int. Cl.
*F25B 1/00* (2006.01)
*F04D 29/058* (2006.01)
(Continued)

(52) U.S. Cl.
CPC ..... *F04D 29/058* (2013.01); *F01D 5/04* (2013.01); *F04D 25/02* (2013.01); *F04D 25/024* (2013.01);
(Continued)

(58) Field of Classification Search
CPC .. F04D 29/5806; F04D 29/058; F04D 25/024; F04D 29/284; F04D 29/053;
(Continued)

(56) References Cited

U.S. PATENT DOCUMENTS 6,310,414 B1 * 10/2001 Agahi ..... F01D 3/04 310/40.5
2006/0225461 A1 10/2006 Paradowski
(Continued)

FOREIGN PATENT DOCUMENTS

EP 1913117 4/2008
JP H07-091160 4/1995
(Continued)

OTHER PUBLICATIONS

"International Preliminary Report on Patentability; this report contains the following items :Form PCT/IB/338, Form PCT/IB/373, PCT/ISA237(cover sheet), PCT/ISA237(Box No. I),PCT/ISA237(Box No. V), PCT/IB/326", dated May 17, 2016, which is English translation of "Written Opinion of the International Searching Authority", p. 1-p. 13.
(Continued)

*Primary Examiner* — Len Tran
*Assistant Examiner* — Ana Vazquez
(74) *Attorney, Agent, or Firm* — JCIPRNET

(57) ABSTRACT

An expander-integrated compressor is provided and includes: a motor; a compressor connected to an output shaft of the motor; an expander connected to the output shaft of the motor; a non-contact bearing disposed between the compressor and the expander; a casing; and an extraction line being in communicated with a region between the compressor and the expander in the internal space of the casing and extracts, from the region, the leakage fluid from the compressor side toward the expander side in the casing
(Continued)

and to send the leakage fluid to a fluid line connected to the intake side or the discharge side of the compressor outside the casing. The casing seals the region from outside of the casing, thus the flow of the at least a part of the leakage fluid through the extraction line is the only flow of fluid between the region and the outside of the casing.

4 Claims, 5 Drawing Sheets

(51) Int. Cl.

| | |
|---|---|
| ***F25B 11/02*** | (2006.01) |
| ***F25B 9/00*** | (2006.01) |
| ***F25B 49/02*** | (2006.01) |
| ***F04D 25/06*** | (2006.01) |
| ***F04D 29/051*** | (2006.01) |
| ***F01D 5/04*** | (2006.01) |
| ***F04D 25/02*** | (2006.01) |
| ***F04D 29/053*** | (2006.01) |
| ***F04D 29/08*** | (2006.01) |
| ***F04D 29/28*** | (2006.01) |
| ***F25B 9/06*** | (2006.01) |
| ***F04D 29/58*** | (2006.01) |
| *F25B 31/00* | (2006.01) |
| *F25B 40/00* | (2006.01) |

(52) U.S. Cl.
CPC ..... *F04D 25/06* (2013.01); *F04D 29/051* (2013.01); *F04D 29/053* (2013.01); *F04D 29/083* (2013.01); *F04D 29/284* (2013.01); *F04D 29/5806* (2013.01); *F25B 9/002* (2013.01); *F25B 9/06* (2013.01); *F25B 11/02* (2013.01); *F25B 49/02* (2013.01); *F05D 2210/14* (2013.01); *F25B 31/006* (2013.01); *F25B 40/00* (2013.01); *F25B 2400/0751* (2013.01); *F25B 2400/14* (2013.01); *F25B 2500/22* (2013.01); *F25B 2600/0261* (2013.01); *F25B 2600/2515* (2013.01); *F25B 2700/151* (2013.01); *F25B 2700/21* (2013.01); *F25B 2700/21163* (2013.01)

(58) Field of Classification Search
CPC ..... F04D 29/083; F04D 25/02; F04D 5/04; F04D 29/051; F04D 25/06; F25B 2500/22; F25B 31/006; F25B 9/06; F25B 9/002; F25B 49/02; F25B 11/02; F25B 2600/2515; F25B 2700/21; F25B 2400/14; F25B 2700/151; F25B 2600/0261; H02K 7/09; F05D 2210/14
See application file for complete search history.

(56) References Cited

U.S. PATENT DOCUMENTS

| | | | |
|---|---|---|---|
| 2007/0101755 | A1 | 5/2007 | Kikuchi et al. |
| 2007/0101756 | A1 | 5/2007 | Okuda et al. |
| 2010/0024474 | A1 | 2/2010 | Kaart et al. |
| 2011/0041526 | A1 | 2/2011 | Okuda et al. |
| 2016/0076793 | A1 | 3/2016 | Nakamura et al. |

FOREIGN PATENT DOCUMENTS

| | | |
|---|---|---|
| JP | H10-148408 | 6/1998 |
| JP | H11-211244 | 8/1999 |
| JP | 2001123997 | 5/2001 |
| JP | 2005098604 | 4/2005 |
| JP | 2006118772 | 5/2006 |
| JP | 2008536078 | 9/2008 |
| JP | 2008298322 | 12/2008 |
| JP | 4370328 | 11/2009 |
| JP | 2010043780 | 2/2010 |
| JP | 2010516994 | 5/2010 |
| JP | 2013155972 | 8/2013 |
| JP | 2014001916 | 1/2014 |
| JP | 2014126284 | 7/2014 |
| JP | 2014219125 | 11/2014 |
| KR | 1020100049726 | 5/2010 |
| RU | 26254 | 11/2002 |
| RU | 2330994 | 8/2008 |
| WO | 2006011248 | 2/2006 |
| WO | 2006011297 | 2/2006 |
| WO | 2014178240 | 11/2014 |

OTHER PUBLICATIONS

"International Search Report (Form PCT/ISA/210) of PCT/JP2014/077109", dated Dec. 22, 2014, with English translation thereof, pp. 1-4.

"International Preliminary Report on Patentability; this report contains the following items :Form PCT/IB/326, PCT/IB/338, PCT/IB/373, PCT/ISA237(cover sheet), PCT/ISA237(Box No. I), PCT/ISA237(Box No. V), PCT/ISA237(Box No. VI), PCT/ISA237(Box No. VII)", dated Jun. 30, 2015, which is English translation of "Written Opinion of the International Searching Authority", p. 1-p. 21.

"Office Action of Korea Counterpart Application," dated Aug. 23, 2017, with English translation thereof, p. 1-p. 12, in which the listed reference was cited.

"Office Action of Russia Counterpart Application," with English translation thereof, dated Nov. 9, 2017, p. 1-11, in which the listed reference was/references were cited.

"Office Action of Japan Counterpart Application," with machine English translation thereof, dated Mar. 9, 2018, p. 1-12.

"Search Report of Europe Counterpart Application", dated Jan. 22, 2018, p. 1-9, in which the listed references were cited.

* cited by examiner

EXPANDER-INTEGRATED COMPRESSOR, REFRIGERATOR AND OPERATING METHOD FOR REFRIGERATOR

CROSS-REFERENCE TO RELATED APPLICATION

This application is a 371 of international application of PCT application serial no. PCT/JP2014/077109, filed on Oct. 9, 2014, which claims the priority benefit of Japan application no. 2013-233149, filed on Nov. 11, 2013. The entirety of each of the above-mentioned patent applications is hereby incorporated by reference herein and made a part of this specification.

TECHNICAL FIELD

The present disclosure relates to an expander-integrated compressor, a refrigerator, and a method for operating a refrigerator.

BACKGROUND

As a compressor to perform the compression stroke in the refrigeration cycle in a refrigerator, a compressor employing a non-contact bearing such as a magnetic bearing as a bearing for the output shaft of the motor driving the compressor, is used. The non-contact bearing supports a rotation shaft of e.g. an output shaft of a motor without contact. Thus, in comparison with a rolling-element bearing, which supports a rotation shaft in contact with the rotation shaft, a non-contact bearing does not cause mechanical friction loss with a rotation shaft and it is excellent in durability due to no friction. Thus, a compressor employing a non-contact bearing such as a magnetic bearing as the bearing for the output shaft of the motor is used when the motor is supposed to be used at a high rotational speed, for example.

Patent Document 1 discloses a turbine compressor employing a magnetic bearing where a turbine impeller is mounted on an end and a compressor impeller on the other end of a shaft and the shaft is supported by the magnetic bearing, which is an example of an expander-integrated compressor employing a non-contact bearing as described above.

CITATION LIST

Patent Literature

Patent Document 1: JP H7-91760 A

SUMMARY

Technical Problem

When the expander-integrated compressor as disclosed in Patent Document 1 is employed for a refrigerator, a part of expansion energy generated when a fluid expands in the expander is recovered, and the recovered expansion energy is used as a rotational energy for the motor rotation shaft to drive the compressor. Thus, the power for the motor may be reduced, and the coefficient of performance (COP) may be improved.

In this regard, in order to further improve the energy efficiency, it is desired to further improve COP.

It is an object of at least an embodiment to provide an expander-integrated compressor, a refrigerator and a method for operating a refrigerator, capable of improving COP of a refrigerator.

Solution to Problem

An expander-integrated compressor according to at least an embodiment of the present invention includes: a motor; a compressor connected to an output shaft of the motor and configured be driven by the motor to compress fluid; an expander connected to the output shaft of the motor and configured to expand the fluid to recover power for the output shaft from the fluid; at least one non-contact bearing disposed between the compressor and the expander, and configured to support the output shaft without contact; a casing for accommodating the motor, the compressor, the expander and the at least one non-contact bearing; and an extraction line provided so as to be in communication with a region between the compressor and the expander in an internal space of the casing, and configured to extract and send at least a part of leakage fluid from a side on the compressor toward a side on the expander in the internal space of the casing, from the region to a fluid line connected to an intake side or a discharge side of the compressor outside the casing. The casing is configured to seal the region from outside of the casing so that a flow of the at least a part of leakage fluid through the extraction line is the only fluid flow between the region and the outside of the casing.

In the expander-integrated compressor, the region between the expander and the compressor, in the internal space of the casing, is not originally a flow path of the working fluid. Thus, seals are usually provided between the compressor and the above-described region and between the expander and the above-described region so that the working fluid does not leak from the compressor or the expander to the above-described region. However, even if such seals are provided, it is difficult to completely seal the working fluid to prevent it from leaking from the compressor side.

As a result of an extensive study by the present inventors, they have found that a part of the working fluid compressed by the compressor may leak through a small gap in the seal, from the compressor side via the region to the expander side, and that the leakage fluid having flowed into the expander side and having a high temperature may cause reduction in the adiabatic efficiency of the expander.

The expander-integrated compressor according to the above embodiment has been made based on the above discovery by the present inventors, and in the above embodiment, the extraction line is provided so as to be in communicated with the region between the compressor and the expander in the internal space of the casing, and at least a part of the leakage fluid from the compressor side toward the expander side in the casing is extracted and sent from the region to a fluid line connected to the intake side or the discharge side of the compressor outside the casing. Thus, the leakage fluid having a high temperature flowing into the expander side is reduced, and heat transfer from the high-temperature leakage fluid to the expander is reduced, whereby it is possible to suppress reduction in the adiabatic efficiency of the expander due to the leakage fluid from the compressor side. It is thereby possible to improve COP of the refrigerator employing the expander-integrated compressor.

Further, if the casing is not sealed from the outside and a gas other than the leakage fluid from the region toward the fluid line is allowed to flow from the outside of the casing into the region, heat may transfer from the gas which flows from the outside of the casing into the region to the expander side which has a relative low temperature. Thus, not only the leakage fluid but also a gas having flowed from the outside of the casing into the region may be a factor of unintended heat input to the expander side, and even if a extraction line is provided, it is difficult to effectively suppress such unintended heat input to the expander side. In contrast, in the expander-integrated compressor according to the above embodiment, the region is sealed from the outside of the casing so that the flow of the at least a part of the leakage fluid through the extraction line is the only fluid flow between the region and the outside of the casing. Thus, unintended heat input factor to the expander side is basically only the leakage fluid. Thus, by forming a flow of the working fluid for introducing at least a part of the leakage fluid from the compressor side toward the expander side in the region to the fluid line, it is possible to effectively suppress unintended heat input to the expander side, and thereby to improve COP remarkably.

In some embodiments, the expander-integrated compressor further comprises at least one second compressor other than the above-described compressor. The second compressor is connected to the output shaft of the motor.

In some embodiments, the expander-integrated compressor further comprises at least one second compressor other than the above-described compressor. The second compressor is connected to a second output shaft other than the output shaft of the motor.

A refrigerator according to at least an embodiment of the present invention comprises: a cooling part for cooling an object to be cooled by heat exchange with a refrigerant; an expander-integrated compressor having a compressor for compressing the refrigerant and an expander for expanding the refrigerant integrated; and a refrigerant circulation line configured to allow the refrigerant to circulate through the compressor, the expander and the cooling part. The expander-integrated compressor comprises: a motor; the compressor connected to an output shaft of the motor and configured be driven by the motor to compress the refrigerant; the expander connected to the output shaft of the motor and configured to expand the refrigerant to recover power for the output shaft from the refrigerant; at least one non-contact bearing disposed between the compressor and the expander, and configured to support the output shaft without contact; a casing for accommodating the motor, the compressor, the expander and the at least one non-contact bearing; and an extraction line provided so as to be in communication with a region between the compressor and the expander in an internal space of the casing, and configured to extract and send at least a part of leakage refrigerant from a side on the compressor toward a side on the expander in the internal space of the casing, from the region to the refrigerant circulation line connected to an intake side or a discharge side of the compressor outside the casing. The casing is configured to seal the region from outside of the casing so that a flow of the at least a part of the leakage refrigerant through the extraction line is the only fluid flow between the region and the outside of the casing.

In the refrigerator according to the above embodiment, the expander-integrated compressor has the extraction line provided so as to be in communicated with the region between the compressor and the expander in the internal space of the casing, and at least a part of the leakage refrigerant from the compressor side toward the expander side in the casing is extracted and sent from the region to a refrigerant circulation line connected to the intake side or the discharge side of the compressor outside the casing. Thus, the leakage refrigerant having a high temperature flowing into the expander side is reduced, and heat transfer from the high-temperature leakage refrigerant to the expander is reduced, whereby it is possible to suppress reduction in the adiabatic efficiency of the expander due to the leakage refrigerant from the compressor side. It is thereby possible to improve COP of the refrigerator employing the expander-integrated compressor.

Further, if the casing is not sealed from the outside and a gas other than the leakage refrigerant from the region toward the refrigerant circulation line is allowed to flow from the outside of the casing into the region, heat may transfer from the gas which flows from the outside of the casing into the region to the expander side which has a relative low temperature. Thus, not only the leakage refrigerant but also a gas having flowed from the outside of the casing into the region may be a factor of unintended heat input to the expander side, and even if a extraction line is provided, it is difficult to effectively suppress such unintended heat input to the expander side. In contrast, in the refrigerator according to the above embodiment, the region is sealed from the outside of the casing so that the flow of the at least a part of the leakage refrigerant through the extraction line is the only fluid flow between the region and the outside of the casing. Thus, unintended heat input factor to the expander side is basically only the leakage refrigerant. Thus, by forming a flow of the working fluid for introducing at least a part of the leakage refrigerant from the compressor side toward the expander side in the region to the fluid line, it is possible to effectively suppress unintended heat input to the expander side, and thereby to improve COP remarkably.

The expander-integrated compressor further comprises an extraction valve provided on the extraction line for adjusting the extraction amount of the leakage refrigerant, and a controller for controlling the extraction valve. The controller is configured to control an opening degree of the extraction valve on the basis of at least one of a COP of the refrigerator or a temperature difference of the refrigerant between a temperature at the intake side and a temperature at the discharge side of the expander.

COP of a refrigerator may be obtained from power consumption-based COP ($COP_b$) represented by the following formula (1), compression power-based COP ($COP_c$) represented by the following formula (2), or the like:

$$COPb = \frac{(h_6 - h_5) \cdot G}{P} \tag{1}$$

$$COPc = \frac{h_6 - h_5}{h_2 - h_1} \tag{2}$$

where, in the above formulae (1) and (2), G is mass flow rate [kg/s] of the refrigerant circulating in the refrigerant circulation line, P is power (power consumption) [W] of the motor, $h_1$ is enthalpy [J/kg] at inlet of the compressor, $h_2$ is enthalpy [J/kg] at outlet of the compressor, $h_5$ is enthalpy [J/kg] at inlet of a heat exchanger for the cooling part, and $h_6$ is enthalpy [J/kg] at outlet of the heat exchanger for the cooling part.

Heat flowing into the expander side due to the leakage refrigerant decreases as the extraction amount of the leakage refrigerant sent to the refrigerant circulation line increases. On the other hand, if the extraction amount is too much, the amount of the leakage refrigerant increases which is compressed by the compressor but which does not circulate in the refrigerant circulation line and does not contribute to cooling of an object to be cooled, which may lead to increase in the motor power used for compression and reduction in the efficiency of the compressor. Thus, there is an extraction amount (COP maximum extraction amount) with which COP of the refrigerator employing the expander-integrated compressor becomes the largest.

In view of this, the above refrigerator according to the above embodiment, has a controller configured to control an opening degree of the extraction valve on the basis of at least one of a COP of the refrigerator or a temperature difference of the refrigerant between a temperature at the intake side and a temperature at the discharge side of the compressor. Thus, by controlling the extraction amount on the basis of at least one of COP of the refrigerator or the temperature difference of the refrigerant between the temperature at the intake side and the temperature at the discharge side of the expander, so that the extraction amount becomes at a value in the vicinity of the COP maximum extraction amount, depending on the operating condition, it is possible to improve COP of the refrigerator.

In an operation where changes in the conditions are small, the opening degree may be adjusted with a hand valve, and the opening degree may be constant.

A method for operating a refrigerator according to an embodiment of the present invention is a method for operating a refrigerator including an expander-integrated compressor, and the expander-integrated compressor comprising: a motor; a compressor connected to an output shaft of the motor; an expander connected to the output shaft of the motor; at least one non-contact bearing disposed between the compressor and the expander and configured to support the output shaft without contact; and a casing for accommodating the motor, the compressor, the expander and the at least one non-contact bearing. The casing is configured to seal the region from outside of the casing so that a flow of at least a part of leakage fluid through an extraction line is the only fluid flow between the region and the outside of the casing. The method includes: a compression step of compressing a refrigerant by using the compressor; an expansion step of expanding the refrigerant compressed in the compression step by using the expander; a cooling step of cooling an object to be cooled by heat exchange with the refrigerant expanded in the expansion step; and an extraction step of extracting and sending, through an extraction line provided so as to be in communication with a region between the compressor and the expander in an internal space of the casing, at least a part of leakage refrigerant from a side on the compressor toward a side on the expander in the internal space of the casing, from the region to a refrigerant circulation line connected to an intake side or a discharge side of the compressor outside the casing.

According to the operating method according to the above embodiment, in the extraction step, at least a part of the leakage refrigerant from the compressor side toward the expander side in the casing is extracted and sent from the region to a refrigerant circulation line connected to the intake side or the discharge side of the compressor outside the casing through the extraction line provided so as to be in communicated with the region between the compressor and the expander in the internal space of the casing of the expander-integrated compressor. Thus, the leakage refrigerant having a high temperature flowing into the expander side is reduced, and heat transfer from the high-temperature leakage refrigerant to the expander is reduced, whereby it is possible to suppress reduction in the adiabatic efficiency of the expander due to the leakage refrigerant from the compressor side. It is thereby possible to improve COP of the refrigerator employing the expander-integrated compressor.

Further, if the casing is not sealed from the outside and a gas other than the leakage refrigerant from the region toward the refrigerant circulation line is allowed to flow from the outside of the casing into the region, heat may transfer from the gas which flows from the outside of the casing into the region to the expander side which has a relative low temperature. Thus, not only the leakage refrigerant but also a gas having flowed from the outside of the casing into the region may be a factor of unintended heat input to the expander side, and even if a extraction line is provided, it is difficult to effectively suppress such unintended heat input to the expander side. In contrast, in the operating method according to the above embodiment, the region is sealed from the outside of the casing so that the flow of the at least a part of the leakage refrigerant through the extraction line is the only fluid flow between the region and the outside of the casing. Thus, unintended heat input factor to the expander side is basically only the leakage refrigerant. Thus, by aiming a flow of the working fluid for introducing at least a part of the leakage refrigerant from the compressor side toward the expander side in the region to the fluid line, it is possible to effectively suppress unintended heat input to the expander side, and thereby to improve COP remarkably.

In some embodiments, the operating method further comprises an extraction amount adjusting step of adjusting an extraction amount from the region in the internal space of the casing to the intake side of the compressor, on the basis of at least one of a COP of the refrigerator or a temperature difference of the refrigerant between a temperature at the intake side and a temperature at the discharge side of the compressor.

In this case, since the extraction amount is adjusted on the basis of at least one of a COP of the refrigerator or a temperature difference of the refrigerant between a temperature at the intake side and a temperature at the discharge side of the compressor, it is possible to improve COP of the refrigerator.

Advantageous Effects

According to at least an embodiment of the present invention, it is possible to reduce heat transferring from the fluid having leaked from the compressor side in the casing of the expander-integrated compressor to the expander, thereby to improve the coefficient of performance (COP) of the refrigerator.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not limitative of the scope of the present invention.

Figure 1:
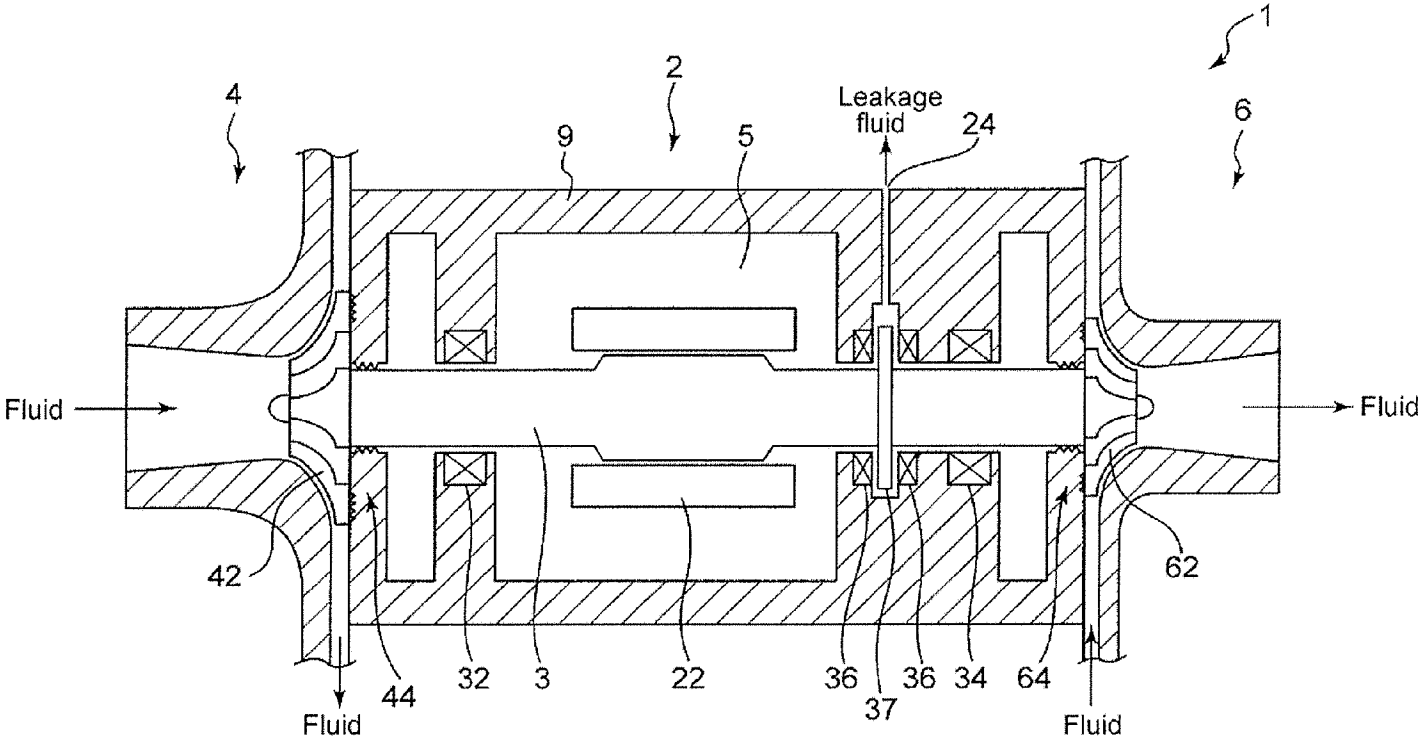
FIG. 1 is a schematic diagram illustrating an expander-integrated compressor according to an embodiment.

FIG. 1 is a schematic diagram of an expander-integrated compressor according to an embodiment. As illustrated in FIG. 1, an expander-integrated compressor 1 includes a motor 2, a compressor 4, an expander 6, non-contact bearings 32, 34 and 36, a casing 9, and an extraction line 24.

The compressor 4 is connected to an output shaft 3 of the motor 2, and is configured to be driven by the motor 2 to compress fluid. On the other hand, the expander 6 is connected to the output shaft 3 of the motor 2, and is configured to expand the fluid to recover power for the output shaft 3 from the fluid. The motor 2 may be provided between the compressor 4 and the expander 6, as illustrated in FIG. 1. In another embodiment, the motor 2 may be provided outside the compressor 4 and the expander (that is, the motor 2, the compressor 4 and the expander 6 may be provided in this order in the axial direction of the output shaft 3).

The output shaft 3 of the motor 2 is supported without contact by radial magnetic bearings 32, 34 and a thrust magnetic bearing 36 (hereinafter referred to also as non-contact bearings 32, 34, 36 or magnetic bearings 32, 34, 36 in this description) which are provided between the compressor 4 and the expander 6, without contact. The radial magnetic bearings 32, 34 are provided on the opposite sides in the axial direction of the output shaft 3, and levitate the output shaft 3 by magnetic force to bear the radial load of the output shaft 3. On the other hand, the thrust magnetic bearing 36 on a side of the motor 2 (between the motor 2 and the expander 6 in the embodiment illustrated in FIG. 1) in the axial direction of the output shaft 3, and bears the thrust load of the output shaft 3 by magnetic force so that a gap is formed between the thrust magnetic bearing 36 and an axial rotor disk 37.

The casing 9 accommodates the motor 2, the compressor 4, the expander 6, and the radial magnetic bearings 32, 34 and the thrust magnetic bearing 36.

The thrust magnetic bearing 36 and the axial rotor disk 37 provided on the output shaft 3 may be disposed between the compressor 4 and the motor 2.

In some embodiments, inside the casing 9 of the expander-integrated compressor 1, a seal portion 44 for suppressing leak of the working fluid from the compressor 4 to the internal space of the casing 9. A seal portion 64 may also be provided for suppressing leak of the working fluid from the expander 6 to the internal space of the casing 9. The seal portions 44, 64 may, for example, be labyrinth seals. In this case, the labyrinth seals 44, 64 may be provided on the back face side of impeller 42 of the compressor 4 or turbine rotor 62 of the expander 6 and between the casing 9 and the impeller 42 or the turbine rotor 62, and, provided around the output shaft 3 and between the output shaft 3 and the casing 9, respectively, as illustrated in FIG. 1.

Nonetheless, even when the seal portion 44 is provided to suppress leak of the working fluid from the compressor 4 to the internal space of the casing 9, it is difficult to completely prevent leak of the working fluid from the compressor 4 to the internal space of the casing 9. That is, inside the casing 9 of the expander-integrated compressor 1, a part of the working fluid compressed by the compressor 4 to have an increased temperature flows from the compressor 4 side into region 5 through a small gap in the seal portion 44 for sealing the region 5 from the back side of the compressor impeller 42. The leakage fluid flowing from the compressor 4 side into the region 5 passed through gaps between the output shaft 3 and the magnetic bearings 32, 34, 36, and further leaks out to the expander 6 side where the operating temperature is relatively low as compared with the operating temperature of the compressor 4.

Thus, due to the leakage fluid having a high temperature from the compressor 4 side, a heat is unintentionally input to the expander 6, and the adiabatic efficiency of the expander 6 may thereby be reduced.

In this regard, in some embodiments, an extraction line 24 is provided so as to extract at least a part of the leakage fluid in the casing 9 from the compressor 4 side to the expander 6 side and to send the at least a part of the leakage fluid to a fluid line connected to the intake side or discharge side of the compressor 4 outside the casing 9.

The extraction line 24 is provided so as to be in communicated with the region 5 between the compressor 4 and the expander 6 in the internal space of the casing 9. In an embodiment, the extraction line 24 extends along the radial direction so as to penetrate the casing 9. The position in the axial direction of the extraction line is not particularly limited, and the extraction line 24 may be formed at the same position as the axial rotor disk 37 provided on the output shaft 3, in the axial direction, as illustrated in FIG. 1.

By providing the extraction line 24, the amount of high-temperature leakage fluid flowing into the expander 6 side may be reduced, and heat transfer from the high-temperature leakage fluid to the expander 6 may thereby be reduced. It is thereby possible to suppress reduction in the adiabatic efficiency of the expander 6 due to leakage fluid from the compressor 4 side, and thereby to improve COP of the refrigerator employing the expander-integrated compressor.

In some embodiments, the casing 9 is configured to seal the region 5 from the outside of the casing 9 so that the flow of the at least a part of the leakage fluid through the extraction line 24 is the only the flow of the fluid between the region 5 and the outside of the casing 9.

If the casing 9 is not sealed from the outside and a gas other than the leakage fluid from the region 5 toward the fluid line is allowed to flow from the outside of the casing 9 into the region 5, a heat may transfer from the gas flowing from the outside of the casing 9 into the region 5, to the expander 6 side, which has a relatively low temperature. Thus, not only the leakage fluid, the gas flowing from outside of the casing 9 into the region 5 may also be a factor of unintended heat input to the expander 6 side, and even if the extraction line 24 is provided, it is difficult to effectively prevent factors of unintended heat input to the expander 6 side. In contrast, in the expander-integrated compressor 1 according to the embodiment, the region 5 is sealed from the outside of the casing 9 so that flow of the at least a part of the leakage fluid through the extraction line 24 is the only fluid flow between the region and the outside of the casing 9. Thus, the leakage fluid is basically only the factor of unintended heat input to the expander 6 side. Thus, by forming the flow of the working fluid, by using the extraction line 24, for introducing at least a part of the leakage fluid from the compressor 4 side toward the expander 6 side in the region 5, it is possible to effectively prevent unintended heat input to the expander 6 side, thereby to improve COP remarkably.

In some embodiments, the expander-integrated compressor further includes a second compressor which is different from the above-describe compressor, and the second compressor is connected to the output shaft of the motor.

For example, a second compressor, a compressor 4 and an expander 6 may be connected to the output shaft 3 of the motor 2 so that the second compressor, the compressor 4, the motor 2, and the expander 6 are arranged in this order.

Further, in some embodiments, the expander-integrated compressor 1 may include at least two second compressors other than the compressor 4.

The at least one second compressor may be connected to an output shaft of a motor other than the motor 2 and driven by this motor. For example, a second compressor may be connected to each of the opposite sides of the output shaft of a motor other than the motor 2, that is, the expander-integrated compressor may have three compressors for one expander.

A refrigerator according to embodiments will now be described with reference to FIG. 2 to FIG. 4.

Figure 2:
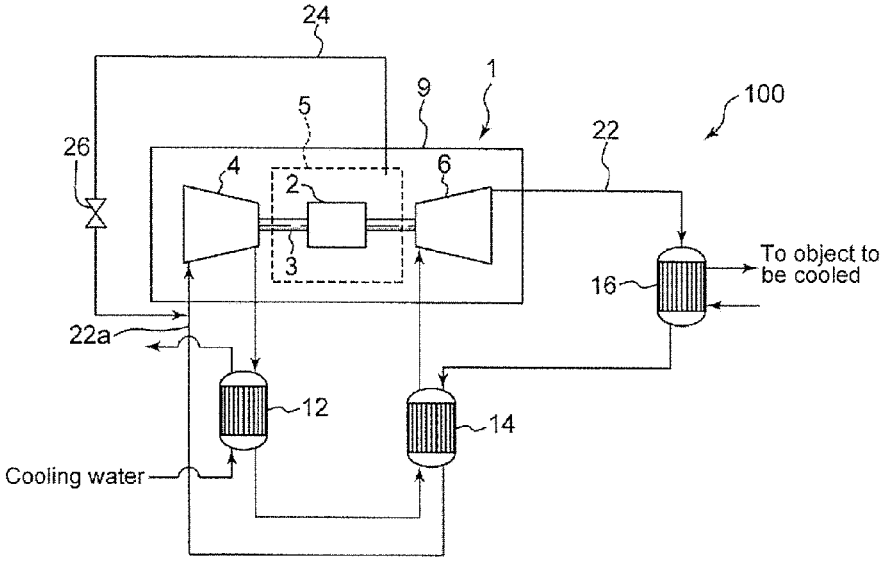
FIG. 2 is a schematic diagram illustrating a refrigerator according to an embodiment.
Figure 3:
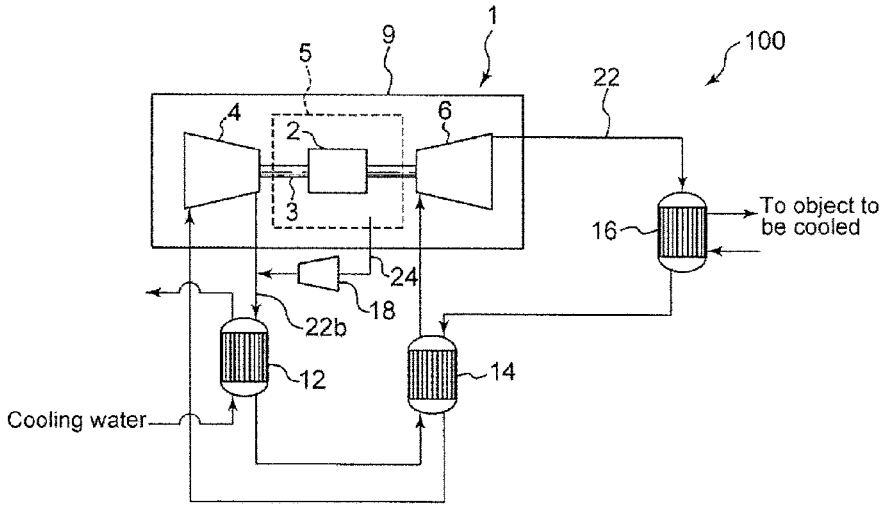
FIG. 3 is a schematic diagram illustrating a refrigerator according to an embodiment.
Figure 4:
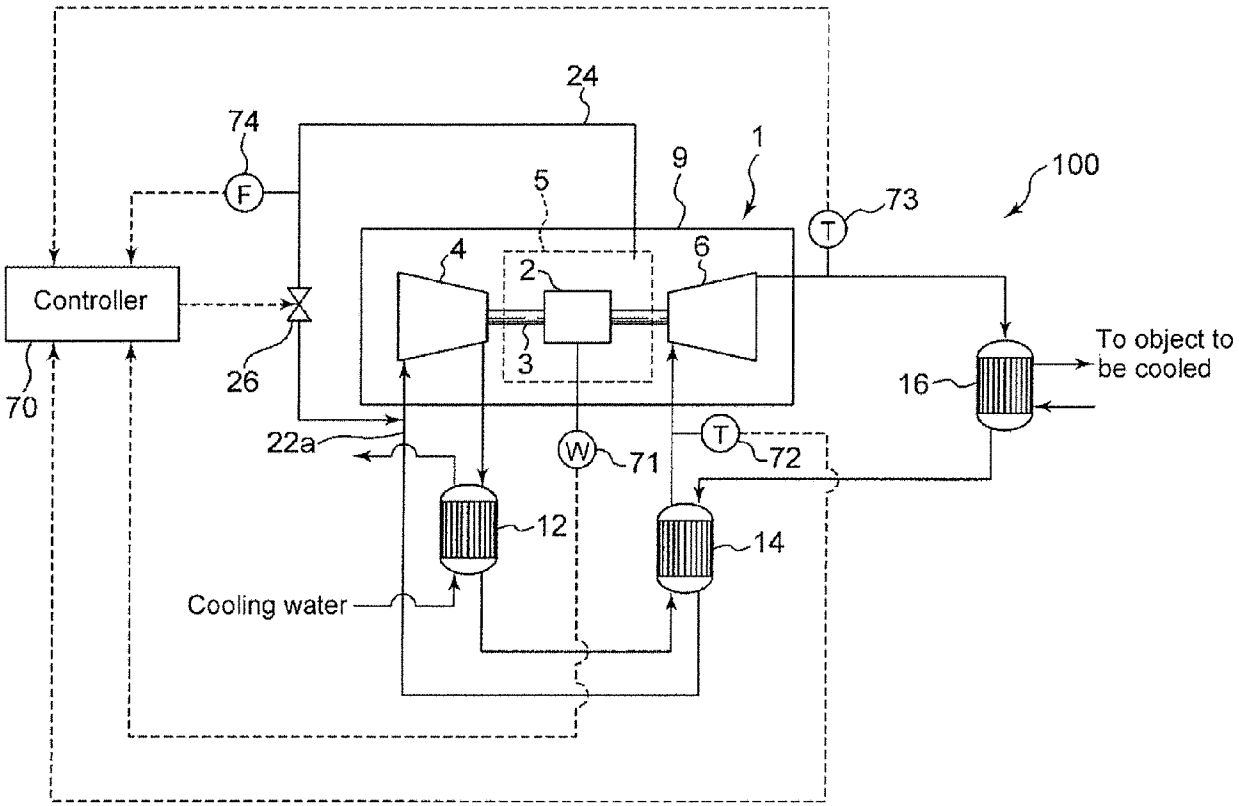
FIG. 4 is a schematic diagram illustrating a refrigerator according to an embodiment.

Each of FIG. 2 to FIG. 4 is a schematic diagram illustrating a refrigerator according to an embodiment.

As illustrated in FIG. 2 to FIG. 4, a refrigerator 100 includes a cooling part 16 for cooling an object to be cooled, an expander-integrated compressor 1 having a compressor 4 and an expander 6 integrated, and a refrigerant circulation line 22. In the refrigerator 100 illustrated in FIG. 2 to FIG. 4, the expander-integrated compressor 1 as illustrated in FIG. 1, which has the extraction line 24, is used as the expander-integrated compressor 1.

In some embodiments, as illustrated in FIG. 2 to FIG. 4, the compressor 4, a heat exchanger 12, a cold heat recovering heat exchanger 14, the expander 6 and the cooling part 16 are provided in this order on the refrigerant circulation line 22, and the refrigerant circulation line 22 is configured to permit a refrigerant circulate through these devices. The compressor 4 is connected to an output shaft 3 of the motor 2 and is configured to be driven by the motor 2 to compress the fluid. The expander 6 is connected to the output shaft 3 of the motor 2 and is configured to expand the fluid to recover power for the output shaft 3 from the fluid.

The heat exchanger 12 is provided for cooling the refrigerant by heat exchange with cooling water, and the cold heat recovering heat exchanger 14 is provided for recovering a cold heat of the refrigerant.

The cooling part 16 is provided for cooling the object to be cooled by heat exchange with the refrigerant.

The refrigerant circulating in the refrigerant circulation line 22 is compressed by the compressor 4 to have increased temperature and pressure, and then is cooled by heat exchange with cooling water in the heat exchanger 12 provided on the downstream side. Thereafter, the refrigerant is further cooled by the cold heat recovering heat exchanger 14, and then is expanded by the expander 6 to have decreased temperature and pressure thereby to generate a cold heat.

The refrigerant discharged from the expander 6 cools the object to be cooled by heat exchange with the object to be cooled in the cooling part 16, and the temperature of the refrigerant is increased by a heat load.

The refrigerant having a temperature increased by the cooling part 16 is introduced to the cold heat recovering heat exchanger 14, and exchanges heat with compressed refrigerant having passed through the heat exchanger 12 and having a relatively high temperature to permit the compressed refrigerant to recover the remaining cold heat. Then the refrigerant goes back to the compressor 4, and then is again compressed by the compressor 4, as described above.

This refrigerating cycle is formed in the refrigerator 100.

In some embodiments, the object to be cooled by heat exchange with the refrigerant in the cooling part 16 is liquid nitrogen for cooling a superconductive device such as a superconductive cable. In this case, cooling at a very low temperature is needed for the superconductive device to be in a superconductive state. In this regard, since the refrigerant has a very low temperature on the discharge side of the expander 6 of the refrigerator 100, the difference between the temperature of the compressor 4 side and the temperature of the expander 6 side, in the refrigerant circulation line 22. For example, in an embodiment, while the temperature in the refrigerant circulation line 22 is about 30° C. to 40° C. on the intake side of the compressor 4 and about 90° C. to 120° C. on the discharge side thereof, the temperature is about −190° C. to −200° C. on the intake side of the expander 6 and about −210° C. to −220° C. on the discharge side thereof.

Since the temperature difference between the compressor 4 side and the expander 6 side is large in this manner, there is also a large temperature difference in the casing 9 between on the compressor 4 side and the expander 6 side. Even if the amount of the leakage refrigerant from the compressor 4 side toward the expander 6 side is small, the leakage refrigerant may be a factor to reduce the adiabatic efficiency of the expander. Thus, it is largely meaningful particularly in the field treating very low temperatures that heat flowing from the compressor 4 side to the expander 6 side can be reduced by providing the extraction line to extract a high-temperature leakage refrigerant and send it to outside of the casing 9.

The refrigerant flowing in the refrigerant circulation line may be suitably selected depending on e.g. a target temperature of the object to be cooled, and it may, for example, be helium, neon, hydrogen, nitrogen, air or hydrocarbon.

In some embodiments, as illustrated in FIG. 2 and FIG. 4, the extraction line 24 in communication with a region 5 between the compressor 4 and the expander 6 in the internal space of the casing 9 of the expander-integrated compressor 1, is connected to the refrigerant circulation line 22*a* which is connected to the intake side of the compressor 4 outside the casing 9. On the extraction line 24, an extraction valve 26 for adjusting the extraction amount is provided.

By providing the extraction line 24, the amount of the high-temperature leakage fluid flowing into the expander 6 side is reduced, and heat transfer from the high-temperature fluid to the expander 6 is reduced, whereby it is possible to suppress reduction in the adiabatic efficiency of the expander 6 due to the leakage fluid from the compressor 4 side. Further, by allowing the high-temperature leakage fluid flowing into the expander 6 side to flow back to the refrigerant circulation line 22 through the extraction line 24, it is possible to allow the leakage fluid to contribute to cooling of the object to be cooled. Thus it is possible to improve COP of the refrigerator 100.

Further, since the extraction valve 26 is provided on the extraction line 24, pressure difference arises in the extraction line 24 across the extraction valve 26. That is, on the upstream side (the region 5 side) of the extraction valve 26 in the extraction line 24, the pressure is relatively high because refrigerator having been compressed by the compressor and having an increased temperature is present. In contrast, on the downstream side (the refrigerant circulation line 22*a* side) of the extraction valve 26 in the extraction line 24, the refrigerant has a relatively low pressure before being compressed by the compressor 4. Thus, since a pressure difference arises across the extraction valve 26 in the extraction line 24, the leakage refrigerant present on the region 5 side where the pressure is relatively high naturally flows to the refrigerant circulation line 22*a* side where the pressure is relatively low, due to the pressure difference. Thus, it is possible to easily allow the leakage refrigerant present in the region 5 to flow back to the refrigerant circulation line 22 without applying power, whereby it is possible to provide excellent energy efficiency and to improve COP.

The refrigerant circulation line 22*a* connected to the intake side of the compressor 4 is a part in the refrigerant circulation line 22 which the refrigerant having a decreased temperature flows back to after the cold heat has been consumed, and the part has a relatively high temperature in the whole refrigerant circulation line 22. Thus, even if the high-temperature leakage refrigerant present in the region 5 in the casing 9 is allowed to flow into the refrigerant circulation line 22*a* connected to the intake side of the compressor 4 side, this is less likely to be a factor to reduce the performance of the refrigerator 100.

In the refrigerator 100 illustrated in FIG. 3, the extraction line 24 in communication with the region 5 between the compressor 4 and the expander 6 in the internal space of the casing 9 of the expander-integrated compressor 1, is connected to a refrigerant circulation line 22*b* which is connected to the discharge side of the compressor 4 outside the casing 9. Further, on the extraction line 24, an extraction compressor 18 is provided for compressing and sending the leakage refrigerant, which flows from the compressor 4 side toward the expander 6 side in the casing 9, from the region 5 to the refrigerant circulation line 22*b*.

By providing the extraction line 24, the amount of the high-temperature leakage fluid flowing into the expander 6 side is reduced, and heat transfer from the high-temperature leakage fluid to the expander 6 is reduced, whereby it is possible to suppress reduction in the adiabatic efficiency of the expander 6 due to the leakage fluid from the compressor 4 side. Further, by permitting the high-temperature leakage fluid flowing to the expander 6 side to flow back to the refrigerant circulation line 22*b* through the extraction line 24, it is possible to reduce power for the motor 2 as compared with the case where the extraction line 24 is connected to the refrigerant circulation line 22*a*.

On the extraction line 24, the extraction compressor 18 for compressing and sending the leakage refrigerant from the region 5 to the refrigerant circulation line 22*b* is provided. With the extraction line 24, the leakage refrigerant is compressed and sent to the refrigerant circulation line 22*b*, and then is joined with the refrigerant having been compressed by the compressor 4 and having an increased pressure, and may be used as a refrigerant for cooling the object to be cooled.

In this regard, power for actuating the extraction compressor 18 is needed separately from the power for actuating the motor 2 of the expander-integrated compressor 1; however, instead, a refrigerant having a relatively high pressure than the refrigerant flowing in the refrigerant circulation line 22*b* joins the refrigerant in the refrigerant circulation line 22*b*, and thus the discharge flow rate of the extraction compressor 18 is added in the refrigerator 100 as a whole, whereby the refrigeration capacity is increased. Thus, it is possible to improve COP.

Further, the refrigerant circulation line 22*b* connected to the discharge side of the compressor 4 is a part of the refrigerant circulation line 22 to which a refrigerant having been compressed by the compressor 4 and having an increased temperature flows, and the part has a relatively high temperature in the refrigerant circulation line 22. Thus, even if the high-temperature leakage refrigerant present in the region 5 in the casing is allowed to flow into the refrigerant circulation line 22*b* connected to the discharge side of the compressor 4, this is less likely to be a factor to reduce the performance of the refrigerator 100.

In an exemplary embodiment illustrated in FIG. 4, the expander-integrated compressor 1 further has a controller 70 for controlling the extraction valve 26 in addition to the same components of the refrigerator as illustrated in FIG. 2.

The controller 70 is configured to control the opening degree of the extraction valve 26 on the basis of at least one of COP of the refrigerator or the temperature difference of the refrigerant between on the intake side and on the discharge side of the expander 6.

The COP of the refrigerator may be calculated from, for example, measurement result of power (power consumption) of the motor 2. In such a case, the power is measured by a power sensor 71, and the measurement result is sent to the controller 70.

The temperatures on the intake side and the discharge side of the expander 6 are measured by a temperature sensor 72 provided on the intake side of the expander 6 and a temperature sensor 73 provided on the discharge side of the expander 6, on the refrigerant circulation line 22, respectively, and the measurement results are sent to the controller 70. The controller 70 calculates the temperature difference of the refrigerant between on the intake side and the discharge side of the expander 6 from the temperatures measured by the temperature sensor 72 and the temperature sensor 73.

Further, the extraction amount of the leakage refrigerant extracted from the region 5 and sent to the refrigerant circulation line 22*a* connected to the intake side of the compressor 4 outside the casing 9 is measured by a flow rate sensor 74 provided on the extraction line 24, and the measurement result is sent to the controller 70.

In some embodiment, the controller 70 is configured to adjust the extraction amount from the region 5 in the casing 9 to the intake side of the compressor 4 on the basis of measurement of e.g. the flow rate of the leakage refrigerant in the extraction line 24, the power of the motor 2, the COP of the refrigerator 100, or the temperature difference of the refrigerant between on the intake side and the discharge side of the expander 6. The COP of the refrigerator may be obtained from the power consumption-based COP ($COP_b$) represented by the above formula (1), or the compression power-based COP ($COP_c$) represented by the above formula (2), for example. In the formulae (1) and (2), G is mass flow rate [kg/s] of the refrigerant circulating in the refrigerant circulation line 22, P is power (power consumption) [W] of the motor 2, $h_1$ is enthalpy [J/kg] at inlet of the compressor 4, $h_2$ is enthalpy [J/kg] at outlet of the compressor 4, $h_5$ is enthalpy [J/kg] at inlet of a heat exchanger for the cooling part 16, and $h_6$ is enthalpy [J/kg] at outlet of the heat exchanger for the cooling part 16.

In an embodiment, the controller 70 has a memory which stores information about operating conditions for the refrigerator 100, including at least one of a target COP of the refrigerator (hereinafter referred to also as "target refrigerator COP") or a temperature difference between on the intake side and the discharge side of the expander 6, and the controller controls the opening degree of the extraction valve 26 to adjust the extraction amount on the basis of at least one of the COP of the refrigerator (hereinafter referred to also as "measured refrigerator COP") calculated from the measurement result by the power sensor 71, etc., or the measurement results by the temperature sensors 72, 73, so that the operating condition is satisfied. The controller 70 may decide a command value of the opening degree for the extraction valve 26 on the basis of the deviation between the information about the operating conditions for the refrigerator 100 stored in the memory and at least one of the measured refrigerant COP or the measurement result of the temperature sensors 72, 73. In such as case, the controller 70 may include a controller such as a P controller, a PI controller or a PID controller, for deciding the opening degree commend value of the extraction valve 26. The operating conditions for the refrigerator 100 with which the COP becomes the largest may vary depending on the cooling load on the cooling part 16. In this case, the controller 70 may adjust the extraction amount on the basis of at least one of the measured refrigerator COP or the measurement results by the temperature sensors 72, 73.

The enthalpies $h_1$, $h_2$, $h_5$ and $h_6$ may be calculated from the measured values of pressures $P_1$, $P_2$, $P_5$ and $P_6$, and temperatures $T_1$, $T_2$, $T_5$ and $T_6$, measured at the respective points. In some embodiments, the refrigerator 100 may be provided with a flow meter (not shown) for measure the mass flow rate of the refrigerant circulating in the refrigerant circulation line 22, temperature sensors (not shown) and pressor sensors (not shown) for measure the temperatures and pressures at the inlet and the outlet of the compressor 4 or at the inlet and the outlet of the cooling part 16.

In another embodiments, the controller 70 has a memory which stores information about at least one of the target refrigerator COP or the maximum value of the temperature difference between on the intake side and on the discharge side of the expander 6, and controls the opening degree of the extraction valve 26 to adjust the extraction amount so that at least one of the measured refrigerator COP of the measurement results by the temperature sensors 72, 73 becomes close to the target refrigerator COP or the maximum value of the temperature difference between on the intake side and on the discharge side of the expander 6. The controller 70 may decide the opening degree command value for the extraction valve 26 on the basis of a deviation between the information stored in the memory about the target refrigerator COP or the maximum value of the temperature difference between on the intake side and the discharge side of the expander 6, and at least one of the measured refrigerator COP or the measurement results by the temperature sensors 72, 73. In this case, the controller 70 may include a controller such as a P controller, a PI controller or a PID controller, for deciding the opening degree command value for the extraction valve 26.

In some embodiments, the controller 70 is configured to adjust the extraction amount from the region 5 in the casing 9 to the intake side of the compressor 4 so that the extraction amount does not exceed the upper limit value which is decided so that the acceptable value of the load (thrust load) on the thrust magnetic bearing 36 is not exceeded.

The magnetic force of the thrust magnetic bearing 36 is controlled by controlling the current so that the levitated position of the output shaft 3 is maintained against the thrust load applied to the output shaft 3. The thrust magnetic bearing 36 has an acceptable value (maximum value) of the load.

The thrust load applied to the output shaft 3 is defined by the deference between the force caused by the pressure in the compression stage on the compressor 4 side (in the outer circumferential part of the impeller 42) and the force caused by the pressure in the expansion stage on the expander 6 side (in the outer circumferential part of the turbine rotor 62). Thus, when the refrigerator is operated in a state where the extraction valve 26 is closed, a load according to the thrust load applied to the output shaft 3 is applied to the thrust magnetic bearing 36, and the current is controlled so that the levitated position of the output shaft 3 is maintained against this load.

Then, if the extraction valve 26 is opened, the leakage refrigerant is extracted and sent outside through the extraction line 24, whereby the pressure in the casing is decreased. In this case, if the diameter of the impeller 42 of the compressor 4 is larger than the diameter of the turbine rotor 62 of the expander 6 as illustrated in FIG. 2, the difference in the force between the front side and the back side of the impeller 42 is larger than that of the turbine rotor 62. If the opening degree of the extraction valve 26 is increased, the thrust load from the compressor 4 side toward the expander 6 side is accordingly increased. Thus, there exists an extraction amount corresponding to the maximum value of the thrust load which the thrust magnetic bearing 36 is capable of bearing.

Therefore, as in the above embodiment, by controlling the opening degree of the extraction valve 26 so that the extraction amount does not exceed the upper limit value decided so that the load on the thrust magnetic bearing 36 does not exceed the acceptable value, it is possible to control the extraction amount within a suitable range where the refrigerator can be operated without problem.

In another embodiment, the controller is configured to control the extraction amount from the region 5 in the casing 9 to the intake side of the compressor 4 so that the thrust load which the thrust magnetic bearing 36 bears does not exceed the load capacity of the thrust magnetic bearing 36.

In an embodiment, the controller 70 controls the opening degree of the extraction valve 26 so that the extraction becomes such that the thrust load which the thrust magnetic bearing 36 bears agrees with the acceptable thrust load, which is a load capacity of the thrust magnetic bearing 36 multiplied by a safety factor.

In this case, it may be that the expander-integrated compressor 1 has a load sensor for measuring the load on the thrust magnetic bearing 36, and that the measurement result by the load sensor is sent to the controller.

Now, the method for operating a refrigerator according to an embodiment will be described with reference to FIG. 1 and FIG. 2.

A method for operating a refrigerator according to an embodiment is a method for operating the refrigerator including the expander-integrated compressor 1 illustrated in FIG. 1, and includes a compression step, an expansion step, a cooling step and an extraction step.

In the compression step, a refrigerant is compressed by the compressor 4, and then, in the expansion step, the refrigerant having been compressed in the compression step is expanded by the expander 6. Then, in the cooling step, an object to be cooled is cooled by heat exchange with the refrigerant having been expanded in the expansion step. In some embodiments, the method may further include, after the compression step and before the expansion step, a step of cooling the refrigerant having been compressed in the compression step.

In the extraction step, at least a part of the leakage refrigerant from the compressor 4 side toward the expander 6 side in the casing 9 is extracted from the region 5 in the casing 9 and sent to the refrigerant circulation line 22*a* which is connected to the intake side of the compressor 4 outside the casing 9, through the extraction line 24 provided so as to be in communication with the region 5 between the compressor 4 and the expander 6 in the internal space of the casing 9.

In the extraction step, at least a part of the leakage refrigerant is extracted from the region 5 in the casing 9 and sent to the refrigerant circulation line 22*a* connected to the intake side of the compressor 4. By doing so, the amount of high-temperature the leakage fluid flowing into the expander 6 side is reduced, and the heat transfer from the high-temperature leakage fluid to the expander 6 is reduced, whereby it is possible to suppress reduction in the adiabatic efficiency of the expander 6 due to the leakage fluid from the compressor 4 side. Further, by permitting the high-temperature fluid flowing into the expander 6 side to flow back to the refrigeration circulation line through the extraction line 24, it is possible to suitably treat the leakage fluid without reducing the refrigeration capacity. Therefore it is possible to improve COP of the refrigerator 100.

Now, a method for operating a refrigerator according to another embodiment will be described with reference to FIG. 1 and FIG. 4.

The method for operating a refrigerator according to the embodiment is a method for operating a refrigerator including the expander-integrated compressor 1 illustrated in FIG. 1, and includes a compression step, an expansion step, a cooling step, an extraction step, and an extraction amount adjusting step.

The compression step, the expansion step, the cooling step and the extraction step are the same as in the method for operating a refrigerator according to the above-described embodiment, and the description thereof will be omitted.

In the extraction amount adjusting step, the extraction amount from the region 5 in the casing 9 to the intake side of the compressor 4 is adjusted on the basis of at least one of COP of the refrigerator or the temperature difference of the refrigerant between on the intake side and on the discharge side of the expander 6.

In some embodiments, the power of motor 2 for calculating COP of the refrigerator is measured by a power sensor 71 for measuring the power (power consumption) of the motor 2, and the measurement result is sent to the controller 70.

The temperatures on the intake side and the discharge side of the expander 6 are measured by a temperature sensor 72 provided on the intake side of the expander 6 and a temperature sensor 73 provided on the discharge side of the expander 6, on the refrigerant circulation line 22, respectively, and the measurement results are sent to the controller 70. The controller 70 calculates the temperature difference of the refrigerant between on the intake side and the discharge side of the expander 6 from the temperatures measured by the temperature sensor 72 and the temperature sensor 73.

Further, the extraction amount of the leakage refrigerant extracted from the region 5 and sent to the refrigerant circulation line 22*a* connected to the intake side of the compressor 4 outside the casing 9 is measured by a flow rate sensor 74 provided on the extraction line 24, and the measurement result is sent to the controller 70.

In some embodiment, the controller 70 is configured to adjust the extraction amount from the region 5 in the casing 9 to the intake side of the compressor 4 on the basis of measurement of e.g. the flow rate of the leakage refrigerant in the extraction line 24, the power of the motor 2, the COP of the refrigerator 100, or the temperature difference of the refrigerant between on the intake side and the discharge side of the expander 6.

In an embodiment, the controller 70 has a memory which stores information about operating conditions for the refrigerator 100, including at least one of a target refrigerator COP or a temperature difference between on the intake side and the discharge side of the expander 6, and the controller controls the opening degree of the extraction valve 26 to adjust the extraction amount on the basis of at least one of the measurement result by the power sensor 71, or the measurement results by the temperature sensors 72, 73, so that the operating condition is satisfied. The controller 70 may decide a command value of the opening degree for the extraction valve 26 on the basis of the deviation between the information about the operating conditions for the refrigerator 100 stored in the memory and at least one of the measurement result by the power sensor 71 or the measurement result of the temperature sensors 72, 73. In such as case, the controller 70 may include a controller such as a P controller, a PI controller or a PID controller, for deciding the opening degree commend value of the extraction valve 26. The operating conditions for the refrigerator 100 with which the COP becomes the largest may vary depending on the cooling load in the cooling part 16. In this case, the controller 70 may adjust the extraction amount on the basis of at least one of the measurement result by the power sensor 71 or the measurement results by the temperature sensors 72, 73 so that the operating conditions corresponding to the cooling load in the cooling part 16 are satisfied.

In another embodiments, the controller 70 has a memory which stores information about at least one of the target refrigerator COP or the maximum value of the temperature difference between on the intake side and on the discharge side of the expander 6, and controls the opening degree of the extraction valve 26 to adjust the extraction amount so that at least one of the measured refrigerator COP or the measurement results by the temperature sensors 72, 73 becomes closer to the target refrigerator COP or the maximum value of the temperature difference between on the intake side and on the discharge side of the expander 6. The controller 70 may decide the opening degree command value for the extraction valve 26 on the basis of a deviation between the information stored in the memory about the target refrigerator COP or the maximum value of the temperature difference between on the intake side and the discharge side of the expander 6, and at least one of the measurement result by the power sensor 71 or the measurement results by the temperature sensors 72, 73. In this case, the controller 70 may include a controller such as a P controller, a PI controller or a PID controller, for deciding the opening degree command value for the extraction valve 26.

In another embodiment, the controller is configured to control the extraction amount from the region 5 in the casing 9 to the intake side of the compressor 4 so that the thrust load which the thrust magnetic bearing 36 bears does not exceed the load capacity of the thrust magnetic bearing 36.

In an embodiment, the controller 70 controls the opening degree of the extraction valve 26 so that the extraction amount becomes such that the thrust load which the thrust magnetic bearing 36 bears agrees with the acceptable thrust load, which is a load capacity of the thrust magnetic bearing 36 multiplied by a safety factor.

In this case, it may be that the expander-integrated compressor 1 has a load sensor for measuring the load on the thrust magnetic bearing 36, and that the measurement result by the load sensor is sent to the controller.

In the extraction amount adjusting step, the extraction amount may be adjusted manually without using the controller.

In some embodiments, the extraction amount from the region 5 in the casing 9 to the intake side of the compressor 4 is adjusted on the basis of the measurement of e.g. the flow rate of the leakage refrigerant in the extraction line 24, the power of the motor 2, the COP of the refrigerator 100 or the temperature difference between on the intake side and on the discharge side of the expander 6.

In an embodiment, a record of information about the operating conditions for the refrigerator 100 including at least one of the target refrigerator COP with which COP becomes the largest, and the temperature difference between on the intake side and on the discharge side of the expander 6 is prepared, and the extraction amount is adjusted by controlling the opening degree of the extraction valve 26 so that the operating conditions are satisfied on the basis of the record and at least one of the measured refrigerator COP or the measurement results of the temperature sensors 72, 73.

The operating conditions for the refrigerator 100 with which COP becomes the largest may vary depending on the cooling load in the cooling part 16. In this case, the extraction amount may be adjusted on the basis of at least one of the measurement result by the power sensor 71 or the measurement results by the temperature sensors 72, 73 so that the operating conditions corresponding to the cooling load in the cooling part 16 are satisfied.

In another embodiment, a record of information about at least one of the target refrigerator COP or the maximum value of the temperature difference between on the intake side and on the discharge side of the expander 6 is prepared, and the extraction amount is adjusted by controlling the opening degree of the extraction valve 26 so that at least one of the measured refrigerator COP or the measurement results by the temperature sensors 72, 73 becomes closer to the target refrigerator COP or the maximum value of the temperature difference between on the intake side and on the discharge side of the expander 6. The opening degree command value for the extraction valve 26 may be decided on the basis of a deviation between the recorded information about the target refrigerator COP or the maximum value of the temperature difference between on the intake side and the discharge side of the expander 6, and at least one of the measured refrigerator COP or the measurement results by the temperature sensors 72, 73.

In another embodiment, the extraction amount from the region 5 in the casing 9 to the intake side of the compressor 4 is controlled so that the thrust load which the thrust magnetic bearing 36 bears does not exceed the load capacity of the thrust magnetic bearing 36.

In an embodiment, the opening degree of the extraction valve 26 is adjusted so that the extraction amount becomes such that the thrust load which the thrust magnetic bearing 36 bears agrees with the acceptable thrust load, which is a load capacity of the thrust magnetic bearing 36 multiplied by a safety factor.

Figure 6:
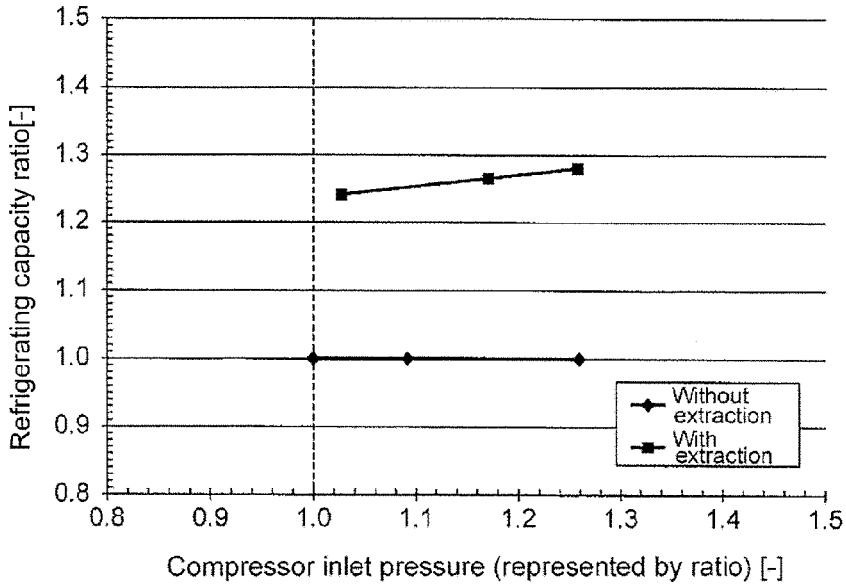
FIG. 6 is a graph showing a comparison of refrigerating capacity ratio between a refrigerator according to an embodiment and a refrigerator according to a comparative example.
Figure 7:
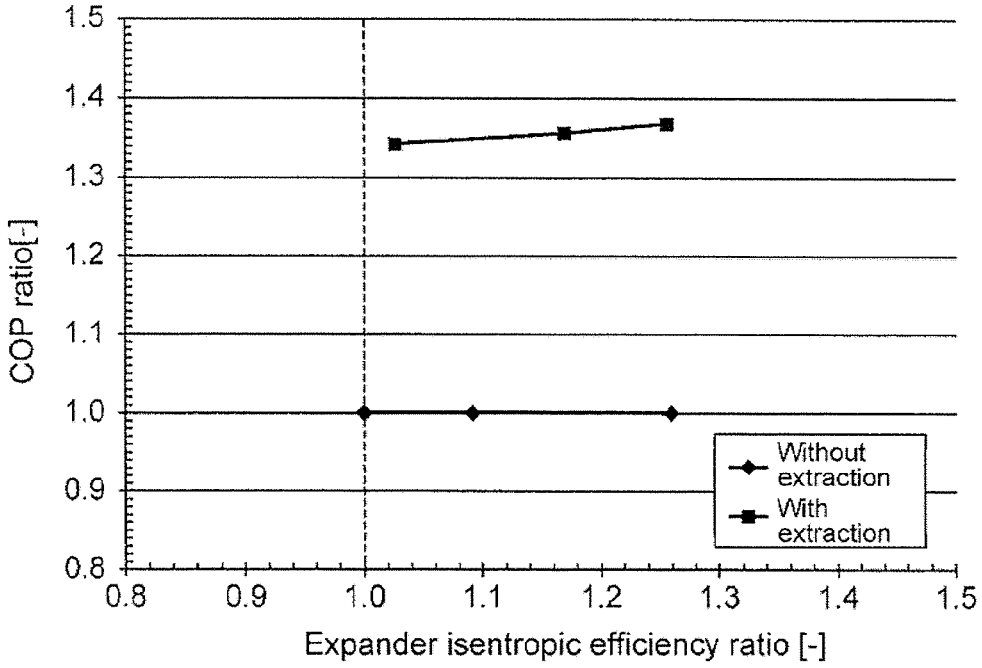
FIG. 7 is a graph showing a comparison of COP ratio between a refrigerator according to an embodiment and a refrigerator according to a comparative example.

Now, an effect of improving COP by the refrigerator according to an embodiment will be described with reference to FIG. 5 to FIG. 7.

Figure 5:
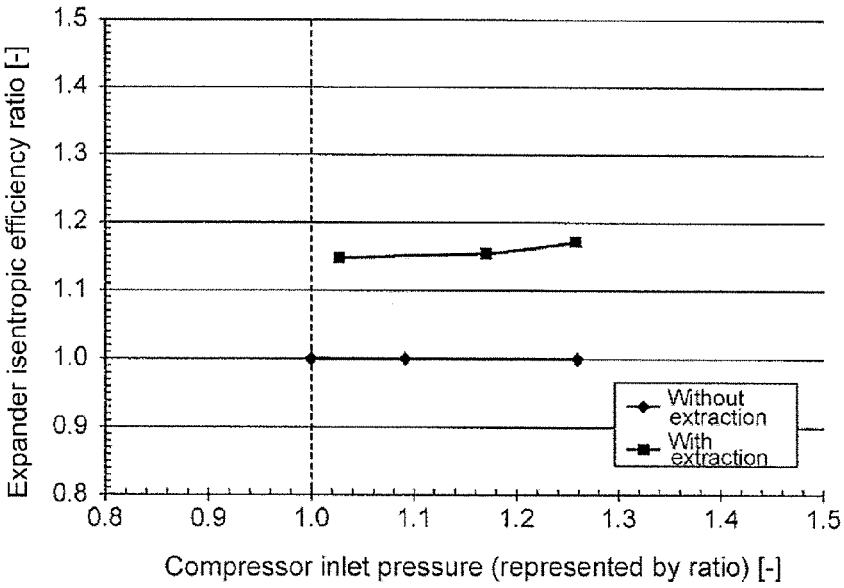
FIG. 5 is a graph showing a comparison of adiabatic efficiency ratio between a refrigerator according to an embodiment and a refrigerator according to a comparative example.

FIG. 5 is a graph showing a comparison of adiabatic efficiency ratio between a refrigerator according to an embodiment and a refrigerator according to a comparative example. FIG. 6 is a graph showing a comparison of refrigerating capacity ratio between a refrigerator according to an embodiment and a refrigerator according to a comparative example. FIG. 7 is a graph showing a comparison of COP ratio between a refrigerator according to an embodiment and a refrigerator according to a comparative example.

In order to evaluate the effect of improving COP by a refrigerator 100 according to an embodiment of the present invention, some measurements were carried out by using the refrigerator 100 illustrated in FIG. 2 provided with the extraction line 24 and the extraction valve 26. Neon was uses as the refrigerant.

As a refrigerator of a comparative example, a refrigerator having the same configuration as the refrigerator 100 illustrated in FIG. 2 except that the extraction line 24 and the extraction valve 26 were not provided, was used.

The refrigerator 100 illustrated in FIG. 2 and the refrigerator of the above-described refrigerator were built, and the power of the motor 2, the temperatures on the intake side and the discharge side of the expander 6, and so on were measured with various intake-side pressure of the compressor 4 to obtain the expander adiabatic efficiency, the refrigerating capacity and COP. The results are shown in FIG. 5 to FIG. 7. The expander adiabatic efficiency ratio, the refrigerating capacity ratio and the COP ratio each represents a ratio given that the result when measurement was carried out "without extraction" is 1. Further, in FIG. 5 to FIG. 7, the reference pressure (the compressor inlet pressure=1) of the "compressor inlet pressure (represented by ratio)" corresponds to 120 kPa.

As shown in FIG. 5, with regard to the refrigerator 100 ("with extraction"), the expander adiabatic efficiency was improved within the measured range of the intake side pressure of the compressor 4, and the expander adiabatic efficiency of the refrigerator 100 was larger by about 18% than the expander adiabatic efficiency of the refrigerator of the comparative example ("without extraction"). Further, as shown in FIG. 6, the refrigerating capacity of the refrigerator 100 was larger by about 28% than that of the comparative example. Further, as shown in FIG. 7, COP (based on the compressor power) was also larger by about 37% than that of the comparative example.

The results show that the refrigerator 100 having the extraction line 24 and the extraction valve 26 provides remarkably improved COP as compared with the refrigerator of the comparative example with no extraction line 24 or extraction valve 26.

The invention claimed is:

1. An expander-integrated compressor, comprising:

a motor;

a compressor, connected to an output shaft of the motor and configured to be driven by the motor to compress fluid;

an expander, connected to the output shaft of the motor and configured to expand the fluid to recover power for the output shaft from the fluid;

at least one non-contact bearing, disposed between the compressor and the expander, and configured to support the output shaft without contact;

a casing, for accommodating the motor, the compressor, the expander and the at least one non-contact bearing;

an extraction line, provided so as to be in communication with a region between the compressor and the expander in an internal space of the casing, and configured to extract and send at least a part of leakage fluid from a side on the compressor toward a side on the expander in the internal space of the casing, from the region to a fluid line connected to an intake side or a discharge side of the compressor outside the casing;

an extraction valve, provided on the extraction line for adjusting the extraction amount of the leakage fluid; and a controller, for controlling the extraction valve, wherein the casing is configured to seal the region from outside of the casing so that a flow of the at least a part of leakage fluid through the extraction line is the only fluid flow between the region and the outside of the casing, and wherein the controller is configured to control an opening degree of the extraction valve on the basis of at least one of a COP of a refrigeration cycle including the expander-integrated compressor or a temperature difference of the fluid between a temperature at the intake side and a temperature at the discharge side of the expander.

2. The expander-integrated compressor according to claim 1, further comprising:

at least one second compressor other than the compressor, wherein the second compressor is connected to a second output shaft other than the output shaft of the motor.

3. A refrigerator, comprising:

the expander-integrated compressor according to claim 1; and a cooling part for cooling an object to be cooled by heat exchange with a refrigerant as the fluid from the expander.

4. A method for operating the expander-integrated compressor according to claim 1, the method comprising:

a compression step of compressing a refrigerant by using the compressor;

an expansion step of expanding the refrigerant compressed in the compression step by using the expander;

a cooling step of cooling an object to be cooled by heat exchange with the refrigerant expanded in the expansion step;

an extraction step of extracting and sending, through the extraction line, at least a part of leakage refrigerant from a side on the compressor toward a side on the expander in the internal space of the casing, from the region in the internal space of the casing to the fluid line; and an extraction amount adjusting step of adjusting the extraction amount from the region in the internal space of the casing to the intake side or the discharge side of the compressor, on the basis of at least one of the COP of the refrigeration cycle of the expander-integrated compressor or the temperature difference of the refrigerant between the temperature at the intake side and the temperature at the discharge side of the compressor.

* * * * *